US005792725A

United States Patent [19]

Simpson et al.

[11] Patent Number: 5,792,725

[45] Date of Patent: *Aug. 11, 1998

[54] THERMAL DYE TRANSFER MAGNETIC ID CARD

[75] Inventors: William Henry Simpson, Pittsford, N.Y.; Bradford D. West, La Jolla, Calif.; Mary-Irene Elizabeth Condo, Rochester, N.Y.

[73] Assignee: Eastman Kodak Company, Rochester, N.Y.

[ * ] Notice: The term of this patent shall not extend beyond the expiration date of Pat. No. 5,698,839.

[21] Appl. No.: 719,046

[22] Filed: Sep. 24, 1996

[51] Int. Cl.[6] ..... B41M 5/035; B41M 5/38

[52] U.S. Cl. ..... 503/227; 428/195; 428/206; 428/412; 428/692; 428/913; 428/914

[58] Field of Search ..... 8/471; 428/195, 428/412, 913, 914, 206, 692; 503/227

[56] References Cited

U.S. PATENT DOCUMENTS 4,927,803 5/1990 Bailey et al. ..... 503/227

OTHER PUBLICATIONS

U.S. application No. 08/418,336, Jagielinski et al., filed Apr. 7, 1995.

U.S. application No. 08/418,731, James et al., filed Apr. 7, 1995.

*Primary Examiner*—Bruce H. Hess

*Attorney, Agent, or Firm*—Harold E. Cole

[57] ABSTRACT

An identification card comprising a card stock comprising a plastic material having magnetic particles uniformly dispersed throughout, the card stock also having an image-receiving layer located on the outermost surface of at least one side of the card stock, the image-receiving layer comprising a polycarbonate having a Tg of less than about 80° C.

9 Claims, No Drawings

THERMAL DYE TRANSFER MAGNETIC ID CARD

This invention relates to a thermal dye transfer identification (ID) card, and more particularly to an ID card having a card stock comprising a plastic material having magnetic particles dispersed throughout.

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to one of the cyan, magenta or yellow signals, and the process is then repeated for the other two colors. A color hard copy is thus obtained which corresponds to the original picture viewed on a screen. Further details of this process and an apparatus for carrying it out are contained in U.S. Pat. No. 4,621,271, the disclosure of which is hereby incorporated by reference.

The use of ID cards has become widespread, especially for driver's licenses, national ID cards, bank and other authority cards, for example. Security is important for such cards, and an important security feature of such cards is the use of a continuous tone color photograph printed in the same layer along with other personal, variable data. This type of information can be rapidly and conveniently placed onto an ID card by use of an electronic camera, a computer, and a computer-controlled digital printer. For example, a video camera or a digital still camera can be used to capture a person's image and a computer can record the corresponding personal, variable data. The image and data can then be printed onto an ID card stock material by a computer-controlled thermal dye transfer printer using the apparatus described in U.S. Pat. No. 4,621,271 referred to above.

Magnetically encodable ID cards are well known and used in many security- or authority-related applications. These cards generally consist of plastic material having a magnetically encodable strip applied thereon. There are many disadvantages of these cards including the possibility of tampering with the magnetic strip on such a card, the wear of the magnetic strip caused by card readers, and the limited information storage space.

U.S. Pat. No. 5,698,839 of Jagielinski et al., relates to an ID card where magnetic particles are embedded throughout the bulk plastic making up the card without having to have a magnetic strip be applied to the surface of the card. Such a card avoids the disadvantages of a magnetic strip on the surface of an ID card described above. With magnetic particles dispersed throughout the bulk of a card, information can be stored anywhere on the card in any desired pattern. This results in a significant increase of medium available for recording information and reduces wear since the card readers do not come into direct contact with the magnetic particles.

The plastic material used for dispersing the magnetic particles in the above-described ID card can also act as a receiver for dyes transferred by thermal printing with a conventional thermal print head. However, there is a problem with using this card in that manner in that the maximum Status A densities obtained for the dyes used in such a process are very low due to the low printing energy which has to be employed in order to avoid sticking of the dye-donor element to the plastic, magnetic material making up the card. When the printing energy is raised to a level high enough to result in acceptable Status A densities, sticking is so severe that the dye-donor element is irreversibly welded to the magnetic medium.

It is an object of this invention to provide an ID card having a bulk magnetic medium which is more susceptible to a thermal printing and imaging process. It is another object to provide an ID card having an acceptable Dmax without sticking of the dye-donor element to the receiving element during the printing process.

These and other objects are achieved in accordance with this invention which comprises an identification card comprising a card stock comprising a plastic material having magnetic particles uniformly dispersed throughout, the card stock also having an image-receiving layer located on the outermost surface of at least one side of the card stock, the image-receiving layer comprising a polycarbonate having a Tg of less than about 80° C.

The plastic material having magnetic particles uniformly dispersed throughout is described more fully in U.S. Pat. No. 5,698,839, referred to above, the disclosure of which is hereby incorporated by reference. A method of making such cards is disclosed in U.S. patent application Ser. No. 08/418,731 of James et al., filed Apr. 7, 1995, the disclosure of which is hereby incorporated by reference.

Any suitable thermoplastic resin may be used for the plastic material used to make up the ID card stock. There may be used, for example, polystyrene, polyamides, vinyl chloride, copolymers of vinyl chloride, polycarbonates, polyolefins, polyesters such as poly(ethylene terephthalate) and poly(ethylene naphthalate), polyurethanes, etc. Metal oxides or mixtures, such as titanium dioxide, zinc oxide, silica, etc., may also be added to the plastic to provide a reflective surface. Colored pigments or dyes may also be added to the plastic in order to provide various optical effects. Lubricants may also be added to the plastic in order to provide low friction or sliding contact between the ID card and a reader.

The magnetic particles dispersed throughout the plastic ID card stock may be a high coercivity material such as barium ferrite, a medium coercivity material, such as is used in the magnetic stripes of conventional ID cards, or a very low coercivity material. Any suitable ferromagnetic particles may be employed, such as g—$Fe_2O_3$, Co—g—$Fe_2O_3$, Co-magnetite, ferromagnetic chromium dioxide, ferromagnetic material particles, ferromagnetic alloy particles, barium ferrite, strontium ferrite, etc. The volume of magnetic particles used in the ID card stock is preferably less than about 5 percent, based on the volume of the resin employed in making the card. This low density of magnetic particles allows one to achieve a neutral reflection density of the card, thereby permitting indicia, images, polygrams, etc. to be made on the card without having the interference of color from the magnetic particles.

In a preferred embodiment of the invention, the image-receiving layer polycarbonate is a bisphenol-A polycarbonate having a number average molecular weight of at least about 25,000. Examples of such polycarbonates include General Electric LEXAN® Polycarbonate Resin, Bayer AG MAKROLON 5700®, and the polycarbonates disclosed in U.S. Pat. No. 4,927,803, the disclosure of which is incorporated by reference.

The polycarbonate employed in the dye image-receiving layer may be present in any amount which is effective for its intended purposes. In general, good results have been obtained at a receiver layer concentration of from about 1 to about 10 g/m$^2$, preferably from about 0.1 to about 5 g/m$^2$.

Between the dye image-receiving layer and the support may be placed other layers such as a subbing layer for improving adhesion, or a compliant or "cushion" layer as disclosed in U.S. Pat. No. 4,734,396, the disclosure of which is hereby incorporated by reference. The function of this layer is to reduce dropouts in the printing process caused by dirt and dust.

In another embodiment of the invention, other features normally used in ID cards may be employed, such as signature panels, holographic foils, etc. These features are placed on the card at appropriate locations.

Dye-donor elements that are used with the ID card dye-receiving element of the invention conventionally comprise a support having thereon a dye-containing layer. Any dye can be used in the dye-donor element employed in the invention provided it is transferable to the dye-receiving layer by the action of heat. Especially good results have been obtained with sublimable dyes. Dye-donor elements applicable for use in the present invention are described, e.g., in U.S. Pat. Nos. 4,916,112; 4,927,803 and 5,023,228, the disclosures of which are hereby incorporated by reference.

As noted above, dye-donor elements are used to form a dye transfer image. Such a process comprises imagewise-heating a dye-donor element and transferring a dye image to a dye-receiving layer on the ID card as described above to form the dye transfer image.

The dye-donor element employed in certain embodiments of the invention may be used in sheet form or in a continuous roll or ribbon. If a continuous roll or ribbon is employed, it may have only one dye thereon or may have alternating areas of different dyes such as cyan, magenta, yellow, black, etc., as disclosed in U.S. Pat. No. 4,541,830.

In a preferred embodiment of the invention, a dye-donor element is employed which comprises a poly(ethylene terephthalate) support coated with sequential repeating areas of cyan, magenta and yellow dye, and the above process steps are sequentially performed for each color to obtain a three-color dye transfer image. Of course, when the process is only performed for a single color, then a monochrome dye transfer image is obtained.

Thermal printing heads which can be used to transfer dye from dye-donor elements to the ID card receiving elements of the invention are available commercially. There can be employed, for example, a Fujitsu Thermal Head FTP-040 MCS001, a TDK Thermal Head F415 HH7-1089, Kyocera KBE-57-12MGL2 Thermal Print Head or a Rohm Thermal Head KE 2008-F3. Alternatively, other known sources of energy for thermal dye transfer may be used, such as lasers as described in, for example, GB No. 2,083,726A.

A thermal dye transfer assemblage of the invention comprises (a) a dye-donor element as described above, and (b) an ID card dye-receiving element as described above, the dye-receiving element being in a superposed relationship with the dye-donor element so that the dye layer of the donor element is in contact with the dye image-receiving layer of the receiving element.

When a three-color image is to be obtained, the above assemblage is formed on three occasions during the time when heat is applied by the thermal printing head. After the first dye is transferred, the elements are peeled apart. A second dye-donor element (or another area of the donor element with a different dye area) is then brought in register with the dye-receiving element and the process repeated. The third color is obtained in the same manner. If the ID card stock has dye-receiving layers on both sides, the thermal printing process can then be applied to both sides of the cards.

After the card is thermally imaged, a transparent protective layer can be formed on the surface of the image-receiving layer if desired. This can be done by use of a dye-donor element which includes an additional non-dye patch comprising a transferable protection layer as disclosed in U.S. Pat. Ser. Nos. 5,332,713 and 5,387,573, the disclosures of which are incorporated by reference. A protective layer applied in this manner provides protection against image deterioration due to exposure to light, common chemicals, such as grease and oil from fingerprints, and plasticizers often found in items made with poly(vinyl chloride) such as wallets.

A clear, protective layer of equal or greater thickness than that applied from the dye-donor may also be applied to the card using a laminator with heat and pressure. Preferably this protective layer is transferred from a carrier film either in-line or off-line from the thermal printer using a hot roll laminator. Protective layer materials employed are clear thermoplastic polymers whose exact composition is dictated by the ability to adhere to the dye image-receiver layer and to provide the desired, specific protective properties. The protective layer must not degrade the image nor affect image stability to heat and light. Such layer may also incorporate other materials, such as ultraviolet light absorbers. The protective layer may also incorporate security devices such as holographic images.

The following example is provided to further illustrate the invention.

EXAMPLE

The following dyes were used in the preparation of the test dye-donor elements:

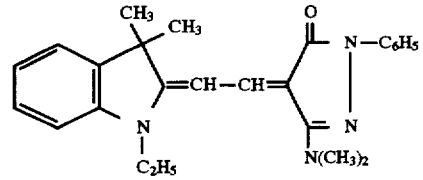

Yellow Dye 1

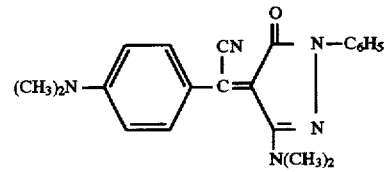

Magenta Dye 2

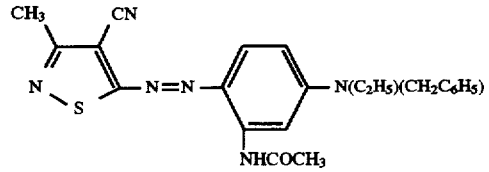

Magenta Dye 3

-continued

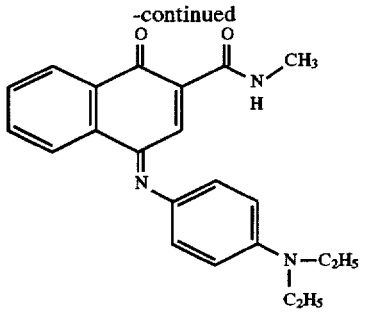

Cyan Dye 4

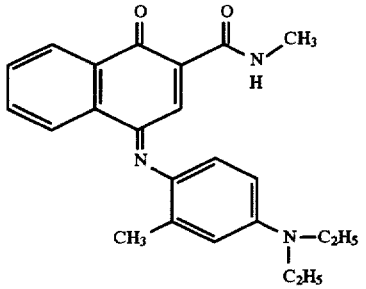

Cyan Dye 5

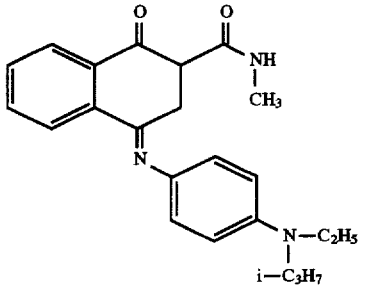

Cyan Dye 6

A. Preparation of Dye-Donor Elements

A poly(ethylene terephthalate) film (6.4 μm) (DuPont Corp.) was coated on both sides with a Tyzor TBT® (titanium tetrabutoxide (DuPont Corp.) subbing layer. On one side of this film was coated a slipping layer of poly(vinyl acetal) (Sekisui Co.) at a laydown of 0.383 g/m$^2$, candelilla wax from Strahl & Pitsch (0.022 g/m$^2$), p-toluenesulfonic acid (0.003 g/m$^2$), and PS513, an aminopropyl dimethyl-terminated polydimethylsiloxane from Huels-America (0.108 g/m$^2$).

On the other side of the above poly(ethylene terephthalate) film were coated dye and transferable protection patches as follows:

a) yellow dye area composed of Dye 1 at 0.269 g/m$^2$, 0.072 g/m$^2$ CAP482-0.5 (a 0.5 s viscosity cellulose acetate propionate) (Eastman Chemical Co.), 0.287 g/m$^2$ CAP482-20 (a 20 s viscosity cellulose acetate propionate) (Eastman Chemical Co.), and 0.022 g/m$^2$ Fluorad® FC-430 fluorinated surfactant (3M Corp.);

b) magenta dye area composed of 0.184 g/m$^2$ Dye 2,0.169 g/m$^2$ Dye 3,0.0037 g/m$^2$ PIDA amide (2,4,6-trimethylanilide of phenylindan-diacid glass) (Eastman Kodak Co.), 0.169 g/m$^2$ CAP 482-0.5, 0.308 g/m$^2$ CAP 482-20, and 0.0022 g/m$^2$ Fluorad® FC-430;

c) cyan dye area composed of 0.127 g/m$^2$ Dye 4,0.115 g/m$^2$ Dye 5, 0.275 g/m$^2$ Dye 6,0.295 g/m$^2$ CAP482-20, and 0.00022 g/m$^2$ Fluorad® FC-430; and d) transferable protection area composed of poly(vinyl acetal) at 0.538 mg/m$^2$, 0.086 g/m$^2$ divinylbenzene beads (4 μm), and 0.011 g/m$^2$ microgel (67 mole-% isobutyl methacrylate/30 mole-% 2-ethylhexyl methacrylate).

B. Bulk Magnetic Medium

The bulk magnetic medium used can be described as a homogeneous blend of three separate constituents: a liquid dispersion of magnetic particles, a white color concentrate, and virgin PETG 6763, an amorphous polyester available from Eastman Chemical Company and defined by the structure shown below.

The procedure for fabrication the bulk magnetic medium was as follows:

1) Dispersion

Two dispersion making methods were used:

a) In a first method, the magnetic particles were dispersed in dibutyl phthalate and a dispersant using an Eiger Machinery Inc. 250 cc mill working with stainless steel (Chromanite) 1.3 mm beads. The shaft speed was 4000 rev/min and the milling time was 2 hrs. The magnetic particles used in the experiments were Secure Mag H, a strontium ferrite available from Hoosier Magnetics, Indiana.

b) In a second method of dispersion making, white reflective and abrasive pigments were dispersed in a glass walled vessel with dibutyl phthalate and dispersant. The milling medium used in this method consisted of zirconia/silica beads. In both cases, the vessels containing the magnetic media were sealed and placed on a roller apparatus for 36 to 96 hrs.

2) Compounding Process With White Color Concentrate and Polyester Base

The above-described dispersions were each hand-blended with GN001-9001G, a white color concentrate (Eastman Chemical Co.) which contained 59 wt-% of R-100 type titanium dioxide. The final component was the above virgin PETG 6763 amorphous polyester.

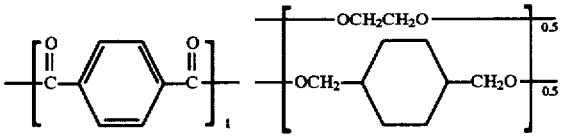

PETG 6763 (Eastman Chemical Co.)

3) Pellet Formation

The hand-blended mixture was then fed into the hopper of a twin screw extruder (Welding Engineers Inc.) which was a counter-rotating, nonintermeshing type of extruder. The final product resulting from this compounding operation consisted of homogeneous pellets containing magnetic medium and pigments in a PETG base. The temperature profile during processing was as follows: barrel temperature of 228° C.; melt temperature 236° C.; die 234° C.; water bath 24° C. Drying conditions prior to process were 66° C. for at least 4 hrs.

4) Extrusion Of Bulk Magnetic Medium

The pellets were extruded into sheet form using an extruder made by Killion Extruders. The temperature profile was as follows:

| | | |
|---|---|---|
| barrel temperatures in | Zone 1 | 232° C. |
| | Zone 2 | 252° C. |
| | Zone 3 | 257° C. |
| | Zone 4 | 266° C. |
| melt temperature | | 279° C. |
| die temperature | | 271° C. |
| roll temperature | top | 4° C. |
| | center | 4° C. |
| | bottom | 82° C. |

drying at 65° C. for at least 4 hrs.

The finished sheet was used as the substrate for the coating of receiver elements as described below.

C. Receiver Element

The receiver element was coated onto the bulk magnetic support using an automated handcoater capable of delivering 10 to 150 mL of solution per square meter of surface from a hopper type coating head and equipped with a vacuum hold-down for the substrate. The layers were applied in a sequential manner. The first coating was dried at 50° C. for 3 minutes before the second coat was applied. After the second coat, the assembly was dried at 50° C. for one hour.

When two receiver layers were coated on the bulk magnetic medium, the first layer consisted of Makrolon® KL3-1013 (Bayer AG) polycarbonate at 1.775 g/m$^2$, Lexan® 141-112 (General Electric Co.) polycarbonate at 1.453 g/m$^2$, Fluorad® FC-431 surfactant (3M Corp.) at 0.011 g/m$^2$, dibutyl phthalate at 0.323 g/m$^2$ and diphenyl phthalate at 0.323 g/m$^2$. The layer was coated from a solvent composed of 80% methylene chloride and 20% trichloroethylene at a wet laydown of 70 cc/m$^2$.

The second, and topmost layer of the receiver element, consisted of a copolymer of 50 mole % bisphenol A, 49 mole % diethylene glycol and 1 mole % of a polydimethylsiloxane block at a laydown of 0.646 g/m$^2$, Fluorad® FC 431 at 0.054 g/m$^2$, and DC 510 (Dow Corning) silicone fluid at 0.054 g/m$^2$. The layer was coated from an 80% methylene chloride 20% trichloroethylene solvent at a wet laydown of 21.5 cc/m$^2$.

It was found that it was possible to coat only one layer of the receiver element and still obtain high dye density without sticking. When a single layer was coated, it was the topmost layer used in the two-layer format above.

C. Printing Conditions

The dye side of the donor element as described above was placed in contact with the topmost layer of the receiver element, described above. The assemblage was placed between a motor driven platen (35 mm in diameter) and a Kyocera® KBE-57-12MGL2 thermal print head which was pressed against the slipping layer side of the dye donor element with a force of 31.2 Newtons. The Kyocera® print head has 672 independently addressable heaters with a resolution of 11.81 dots/mm of average resistance 1968Ω. The imaging electronics were activated and the assemblage was drawn between the print head and the roller at 26.67 mm/s. Coincidentally, the resistance elements in the thermal print head were pulsed on for 87.5 microseconds every 91 microseconds. Printing maximum density required 32 pulses "on" time per printed line of 3.175 milliseconds. The voltage supplied was 14.0 volts resulting in an energy of 4.4 J/cm$^2$ to print a maximum Status A density of 2.2 to 2.3. The image was printed with a 1:1 aspect ratio. A protective layer was transferred to some of the printed receivers by heating uniformly at an energy level of 3.3 J/cm$^2$ with the thermal head to permanently adhere the polymeric film to the topmost layer of the receiver element. The following results were obtained:

TABLE

| | Laminate | Status A Dmax | | |
|---|---|---|---|---|
| Sample | Overcoat | Red | Green | Blue |
| No receiver coats | None | | * | |
| One receiver coat | None | 2.10 | 2.10 | 1.78 |
| Two receiver coats | None | 2.13 | 2.16 | 1.88 |
| One receiver coat | Yes | 2.33 | 2.23 | 1.89 |
| Two receiver coats | Yes | 2.26 | 2.25 | 1.92 |

*Gross sticking, Dmax could not be measured

The above results show that an image of extremely poor quality was obtained using the uncoated bulk magnetic medium because of donor-to-receiver sticking. When a receiver coating of one layer or two layers according to the invention was placed on the surface of the magnetic medium, a very high quality image was obtained with very high dye density.

The invention has been described in detail with particular reference to preferred embodiments thereof, but it will be understood that variations and modifications can be effected within the spirit and scope of the invention.

What is claimed is:

1. An identification card comprising a card stock comprising a plastic material having magnetic particles uniformly dispersed throughout, said card stock also having an image-receiving layer located on the outermost surface of at least one side of said card stock, said image-receiving layer comprising a polycarbonate having a Tg of less than about 80° C.

2. The identification card of claim 1 wherein the concentration of said magnetic particles in said plastic material is less than 5% by volume.

3. The identification card of claim 1 wherein said polycarbonate is a bisphenol-A polycarbonate having a number average molecular weight of at least about 25,000.

4. A process of forming a dye transfer image comprising imagewise-heating a dye-donor element comprising a support having thereon a dye layer and transferring a dye image to a dye-receiving element to form said dye transfer image, said dye-receiving element comprising a card stock comprising a plastic material having magnetic particles uniformly dispersed throughout, said card stock also having an image-receiving layer located on the outermost surface of at least one side of said card stock, said image-receiving layer comprising a polycarbonate having a Tg of less than about 80° C.

5. The process of claim 4 wherein the concentration of said magnetic particles in said plastic material is less than 5% by volume.

6. The process of claim 4 wherein said polycarbonate is a bisphenol-A polycarbonate having a number average molecular weight of at least about 25,000.

7. A thermal dye transfer assemblage comprising:

(a) a dye-donor element comprising a support having thereon a dye layer, and (b) a dye-receiving element comprising a support having thereon a dye image-receiving layer, said dye-receiving element being in a superposed relationship with said dye-donor element so that said dye layer is in contact with said dye image-receiving layer, wherein said dye-receiving element comprises a card stock comprising a plastic material having magnetic particles uniformly dispersed throughout, said card stock also having an image-receiving layer located on the outermost surface of at least one side of said card stock, said image-receiving layer comprising a polycarbonate having a Tg of less than about 80° C.

8. The assemblage of claim 7 wherein the concentration of said magnetic particles in said plastic material is less than 5% by volume.

9. The assemblage of claim 7 wherein said polycarbonate is a bisphenol-A polycarbonate having a number average molecular weight of at least about 25,000.

* * * * *